United States Patent [19]

Stromberger-D'Alton-Rauch et al.

[11] 4,118,229

[45] Oct. 3, 1978

[54] HIGH ENERGY RECORDING ON AN ACETYL ACETONATE

[75] Inventors: Ilse-Dore Stromberger-D'Alton-Rauch; Karl Klose, both of Hamburg; Udo Bergmann, Schwarzenbek; Alfred Glättli, Hamburg, all of Fed. Rep. of Germany; Claus-Peter Hodum, Eindhoven, Netherlands

[73] Assignee: U.S. Philips Corporation, New York, N.Y.

[21] Appl. No.: 726,266

[22] Filed: Sep. 24, 1976

[30] Foreign Application Priority Data

Sep. 25, 1975 [DE] Fed. Rep. of Germany ..... 2542680

[51] Int. Cl.[2] ..... G03C 5/04

[52] U.S. Cl. ..... 96/27 H; 96/27 E; 96/48 QP; 96/88; 346/76 L; 427/53

[58] Field of Search ..... 96/27 E, 27 H, 27 R, 96/88, 48 QP; 346/76 L; 427/53

[56] References Cited

U.S. PATENT DOCUMENTS

| | | | |
|---|---|---|---|
| 3,314,073 | 4/1967 | Becker | 96/27 H X |
| 3,723,121 | 3/1973 | Hauser | 96/27 H |
| 3,787,210 | 1/1974 | Roberts | 96/27 E |
| 3,787,873 | 1/1974 | Sato et al. | 346/76 L |
| 3,834,903 | 9/1974 | Inoue et al. | 96/27 E |

*Primary Examiner*—Edward C. Kimlin

*Attorney, Agent, or Firm*—Frank R. Trifari; Norman N. Spain

[57] ABSTRACT

Method of recording visible data wherein a polymeric layer containing acetyl acetonate is disposed through an image pattern to a laser beam.

8 Claims, 1 Drawing Figure

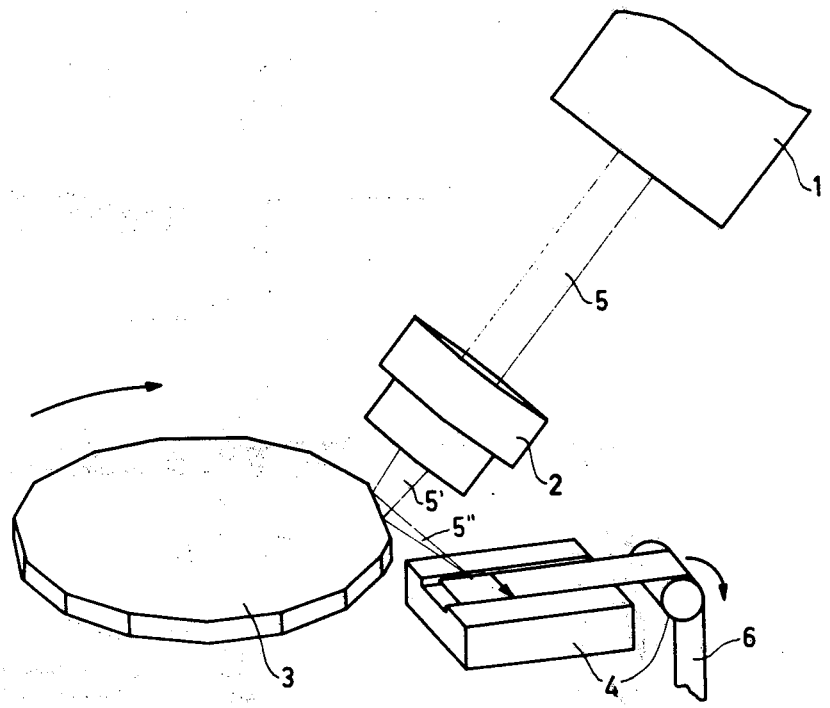
1
5
2
5'
5"
3
4
6

HIGH ENERGY RECORDING ON AN ACETYL ACETONATE

The invention relates to a method for recording irreversible data which become visible immediately and without after-treatment in which a light-absorbing layer is exposed to light of a high intensity and a short duration with an image pattern.

In such a method it is known to use layers which contain inorganic materials, such as, for example, arsenic, selenium, cadmium, zinc and tellurium (German Offenlegungsschrift No. 19 43 391) or metal halides (German Offenlegungsschrift No. 22 28 265). A laser beam is, for example, used as high-energy light.

The layers described in DT-OD No. 19 43 391 have the disadvantage that they do substantially not transmit visible light and that they become more transparent in the exposed areas. Light letters are then, for example, produced on a dark background. Besides that the layers must be coated with a protective layer after exposure to obtain an adequate resistance against scratching. It is also known that metal layers oxidize and fade in the course of time.

The metal halide layers have the disadvantage that they must be exposed to ultra violet light. A shift of the sensitivity into the visible range by adding dyes results in a reduction in the fastness to light. It is also known that dissociated metal halide causes a sluggishness in response as soon as they are embedded in polymer layers or are coated with layers of polymer. In many cases the speed of response is not satisfactorily high until approximately 200° C.

German Offenlegungsschrift No. 21 65 747 discloses a material for the recording of data which contains in at least one layer consisting of polyvinylchloride-acrylic nitrile-copolymerisate polyvinylalcohol, methylester of methacrylic acid or mixtures thereof, a finely distributed acetylacetonate of a transition metal. The material is used for recording data according to the vesicular method. The layer which contains, for example, iron (III)-acetyl acetonate is exposed and thereafter immersed in a hydrogen peroxide solution to develop it. The exposure results in a change in the catalytic activity of the iron (III)-acetyl acetonate with respect to the peroxide, which change is distributed according to the image and due to which oxygen is evolved and used for producing a vesicular image. The dark areas in the image which show when light is transmitted are not caused by absorption of the light but by diffuse scattering at the bubbles.

The material described in German Offenlegungsschrift No. 21 65 747 differs from the materials described in German Offenlegungsschrift Nos. 19 43 391 and 22 28 265 in that it must be subjected to an after-treatment. Furthermore, no laser beams are used in the method described in German Offenlegungsschrift No. 2165747. However, it is also known to produce vesicular images with laser beams (German Offenlegungsschrift No. 21 11 980). It is an object of the invention to provide a method for recording irreversible data which become visible immediately and without after-treatment and which allows the production of black characters on a transparent, light background. The film material to be used must be insensitive to daylight and the light of UV lamps so that a good storability and irreversibility of the recording is obtained.

According to the invention this object is fullfilled by means of a method of the kind mentioned in the preamble, in which the layer contains an acetyl-acetonate which is dissolved or distributed finely dispersed in a polymer, the light having a wavelength, an energy density and an intensity whose values are empirically brought in agreement with the acetyl acetonate used and a ratio being adjusted between the polymer and the acetyl acetonate at which the layer shows a transmission which amounts to 0.1 to 90% for the wave lengths chosen.

Consequently the invention is based on the idea to use a light-sensitive material which has been used sofar only for the vesicular method for recording data which become visible immediately and without after-treatment by means of high-energy light. For this purpose the light sensitive material and the light must be brought in agreement.

A laser beam preferably used as light. Other suitable light sources are, for example, xenon lamps.

In a preferred embodiment of the method according to the invention the layer contains iron (III)-acetyl acetonate, the wave length is chosen between 300 and 550 nm, the energy density amounts to at least 50 $mWs/cm^2$ and the intensity to at least $8.10^6 mW/cm^2$ and the ratio of mix is so adjusted that the transmission of the layer is 10 to 90% at the chosen wave length.

In a further preferred embodiment of the method according to the invention the layer contains manganese (II)-acetyl acetonate, the wavelength is chosen between 300 and 550 nm, the energy density amounts to at least 1000 $mWs/cm^2$ and the intensity to at least $1.7.10^7 mW/cm^2$ and the ratio of mix is so adjusted that the transmission of the layer amounts to 10 to 90% at the chosen wave length.

Upwards the energy density and intensity must be so limited that destruction, (burning) of the layer is avoided.

Preferably the polymer is a polyvinylchloride acrylonitrile copolymer having a viscosity of approximately 1000cP (20% solution in methyl ethyl ketone), ethyl cellulose having ethoxyl content of 47.5 to 49.0% (2.42 to 2.53 ethoxyl groups per unit of anhydro glucose) and a viscosity of 14cP (5% solution in a mixture of toluol: ethyl alcohol = 80:20) or gelatine. It should be noted that polystyrol is not very suitable for the method according to the invention.

Propylene oxide or also phosphoric acid are in the first place suitable as stabilizers.

To achieve that the light-absorbing or light-sensitive layer becomes transparent and colourless (or at least bright yellow) the absorbing material, consequently the acetyl acetonate must be dissolved or distributed finely dispersed in the polymer and must transmit unscattered a highest possible part of the visible light. This requirement is satisfied by introducing the acetyl acetonate in the polymer dissolved in a solvent, for example methyl ethyl ketone or tetrahydrofuran. Thereafter the solvent is evaporated.

The solution consisting of the light-sensitive material, the layer former (the polymer) and stabilizer contains advantageously 0.01 to 10% by weight of acetyl acetonate, 0.1 to 25% by weight of polymer and 0 to 10% by weight of stabilizer.

The wave length of the light beam is so chosen that the light is properly absorbed. In principle it may be between 200 and 20.000 nm; as, however, the efficiency of the laser light in the ultra violet is only small and as in the infrared no small focussing diameter can be obtained, the wave length is advantageously chosen between 400 and 800 nm. Consequently the absorbing layer should absorb, if possible, in blue (400 to 500 nm) and be transparent in the wave length range of the complementary colour yellow (530 to 509 nm). Layers containing iron (III-acetyl acetonate) have these properties to a very high degree.

Suitable acetyl acetonates of other metals are molybdenyl acetyl acetonate and ferrous acetyl acetonate.

It is a characteristic feature of the recording method according to the invention that the formation of dots does not start before both a minimum intensity and also a minimum energy density is irradiated. It this is the case then black dots are formed. Presumably, strongly absorbing decomposition products of the polymer layer for example carbon or combustion residues are concerned or such changes in the polymer layer which are accompanied by a change in the refractive index. The possibility must not be ruled out that the formation of black colour centres is amplified or even catalysed by a thermal chemical decomposition process of the acetyl acetonate, i.e. by the formation of free metal or metal oxide.

The existence of an energy density threshold can be traced back to the fact that the decomposition reaction to be initiated requires a specific energy. However, if the totally required energy is irradiated over a long duration of time at a smaller light intensity then the formation of image points may not take place because of the energy losses owing to heat conductivity. Owing to this fact the irradiated light must also have a minimum intensity.

Owing to the high intensity threshold the layers used according to the invention may be exposed to daylight for any period of time without blackening occurring.

A special advantage of the method according to the invention is in the fact that very small dots are obtained with it. This is based on the fact that the light-sensitive layers used have been obtained from real solutions. As a result there are no grain sizes to impose restrictions on the dots as regards the smallness of their diameter. The dots appear on a transparent, bright background and have sharp edges, so that a good contrast with respect to the unexposed places is obtained.

The recorded data can be immediately inspected visually or electronically. The recorder can also be copied and projected.

The method according to the invention allows the production of 10μm wide dots within a time of exposure of 30 nm.

Above the energy density threshold indicated above there is a small (which can be determined empirically) energy density range in which the dots are not homogeneous. They are composed of many very small points. This effect can be utilized to produce dots with a continuous tone characteristic.

The invention will be further explained with reference to a drawing and examples of a construction.

The FIGURE shows diagrammatically a laser-light-record-arrangement (laser scanning arrangement) having a polygon mirror as deflection unit. Reference 1 is a laser, reference 2 an objective and reference 3 the polygon mirror. Reference 4 indicates a film stopping and transporting unit and references 5, 5' and 5'' indicate the path of the laser beam from the laser via the objective and the polygon mirror to the film 6. The direction in which the polygon mirror, the laser beam 5'' and the film 6 move are indicated by arrows.

EXAMPLE 1

12.5 g of polyvinylchloride-acrylonitrile polymer having a viscosity of approximately 1000cP (20% solution in methyl ethyl ketone; commercial product Saran F120 of Messrs. Dow Chemical Company, described in technical report "Saran resin as binder in magnetic tape coatings") are dissolved in 87.5g of ethyl methyl ketone. 2 g of propylene oxide and 2.5 g of iron(III)acetyl acetonate are added. The solution obtained is applied to a glass sheet by doctor-blading. A plastic tape may also be used as basic layer for the light-sensitive layer. After evaporation of the solvent the layer may be immediately exposed by holding it in the focus of a focussed laser beam. A continuous recording of data is obtained when a film having a light-sensitive layer as shown in the drawing is linearly moved forward and the focussing point of the laser beam 5'' travels over the layer perpendicular to the direction of transport of the layer. Any desired alpha-numerical characters can be produced in this manner in the form of a point matrix. A laser beam modulator (not shown) which is controlled by a character generator switches, for this purpose, the laser beam on or of at the proper moment according to the shape of the alphanumerical character. After exposure the information can be read immediately without necessitating an after-treatment of the layer. 10 μm wide, black dots are produced when the following irradiation conditions are satisified:

| | | |
|---|---|---|
| time of exposure: | 2 μs | 30 ns |
| Laser output: | 90 mW | 13500 mW |
| Irradiation (energy density): | 300 mWs/cm$^2$ | 516 mW/cm$^2$ |
| Intensity: | 1.15.10$^8$mW/cm$^2$ | 1.7.10$^{10}$mW/cm$^2$ |

EXAMPLE 2

The same as example 1, but now instead of 2.5 g of iron (III)-acetyl acetonate, 2 g of manganese-(II) acetyl acetonate are used and to produce a 4 μm wide, black dot the following conditions of irradiation were chosen:

| | |
|---|---|
| time of exposure: | 100 μs |
| Laser output: | 50 mW |
| Irradiation (energy density): | 40000 mWs/cm$^2$ |
| Intensity: | 4.10$^8$ mW/cm$^2$ |

What is claimed is:

1. A method for recording irreversible data which become visible immediately and without after-treatment, in which a light absorbing layer is exposed to light of a high intensity and short duration with an image pattern, characterized in that the layer contains an acetyl acetonate which is dissolved or finely dispersed in a polymer, that the light has a wave length, at which the light-absorbing layer shows high absorption, and an energy density and an intensity whose values are sufficiently high to cause a print-out reaction with the acetyl acetonate containing layer used resulting immediately after exposure in the formation of black dots at the areas of exposure on a transparent light background and that the polymer and acetyl acetonate are mixed in a ratio in which the layer has a transmission which amounts to 0.1 to 90% for the wave length chosen.

2. The method as claimed in claim 1, characterized in that the light is provided by a laser beam.

3. The method as claimed in claim 1, characterized in that the layer is prepared from a solution containing 0.01 to 10% by weight of iron(III)-acetyl acetonate and 0.1 to 25% by weight of polymer, that the wave length is chosen to be between 300 and 550 nm, that the energy density is at least 50 $mWs/cm^2$ and the intensity at least $8.10^6 mW/cm^2$ and that the ratio of mix is so adjusted that the transmission of the layer amounts to 10 to 90% for the wave length chosen.

4. The method as claimed in claim 1, characterized in that the layer is prepared from a solution containing 0.01 to 10% by weight of manganese(II)-acetyl acetonate and 0.1 to 25% by weight of polymer that the wave length has been chosen between 300 and 550 nm, that the energy density is at least 1000 $mWs/cm^2$ and the intensity at least $1.7.10^7 mW/cm^2$ and that the ratio of the mixture is so adjusted that the transmission of the layer amounts to 10 to 90% for the wave length chosen.

5. The method as claimed in claim 1, characterized in that the polymer is a polyvinyl chloride-acrylonitrile copolymer having a viscosity between 950 and 1050 cP, measured at a 20% solution in methyl ethyl ketone.

6. The method as claimed in claim 1, characterized in that the polymer is an ethyl cellulose having an ethoxyl content of 47.5 to 49.0% and a viscosity of 14cP, measured at a 5% solution in a mixture of toluol: ethyl alcohol = 80 : 20.

7. The method as claimed in claim 5, wherein the layer also contains propylene oxide or phosphoric acid.

8. The method of claim 6 wherein the layer also contains phosphoric acid.

* * * * *